US010773837B2

(12) United States Patent
Sun et al.

(10) Patent No.: US 10,773,837 B2
(45) Date of Patent: Sep. 15, 2020

(54) SOLID STATE DISK PACKAGING LINE

(71) Applicant: World Precision Manufacturing (Dongguan) Co., Ltd., Dongguan (CN)

(72) Inventors: Jinsuo Sun, Dongguan (CN); Zhaoyuan Huang, Dongguan (CN); Wenjun Li, Dongguan (CN); Mengtao Yang, Dongguan (CN)

(73) Assignee: WORLD PRECISION MANUFACTURING (DONGGUAN) CO., LTD., Dongguan (CN)

( * ) Notice: Subject to any disclaimer, the term of this patent is extended or adjusted under 35 U.S.C. 154(b) by 146 days.

(21) Appl. No.: 16/206,495

(22) Filed: Nov. 30, 2018

(65) Prior Publication Data

US 2019/0315506 A1 Oct. 17, 2019

(30) Foreign Application Priority Data

Apr. 12, 2018 (CN) ..... 2018 1 0327190

(51) Int. Cl.
*B65B 5/10* (2006.01)
*B65B 43/26* (2006.01)
(Continued)

(52) U.S. Cl.
CPC ..... *B65B 5/105* (2013.01); *B65B 25/002* (2013.01); *B65B 43/26* (2013.01); *B65B 43/265* (2013.01);
(Continued)

(58) Field of Classification Search
CPC ..... B65B 5/045; B65B 5/10; B65B 5/105; B65B 5/12; B65B 25/002; B65B 43/26;
(Continued)

(56) References Cited

U.S. PATENT DOCUMENTS 3,604,184 A * 9/1971 Shuttleworth ..... B65B 61/207 53/157
4,907,397 A * 3/1990 Goodman ..... B65B 5/105 53/156

(Continued)

FOREIGN PATENT DOCUMENTS

JP 52049193 A * 4/1977
JP 01279002 A * 11/1989

(Continued)

*Primary Examiner* — Stephen F. Gerrity
(74) *Attorney, Agent, or Firm* — Shimokaji IP

(57) ABSTRACT

A solid state disk packaging line, for packaging solid state disks, includes a stacking tray conveying system, a packaging system, a packaging box conveying system, and a packaging box packaging system. The packaging system includes a packaging box loading device, a sealing bag loading device, and a packaging machine. Two sides of the packaging system provided with the packaging machine are connected with the stacking tray conveying system and the packaging box conveying system respectively. The packaging machine receives stacking trays, and loads the stacking trays into a packaging box, and then transfers the packaging box to the packaging box packaging system via the packaging box conveying system. The packaging box with the stacking trays loaded therein is sealed by the packaging box packaging system. The packaging line packages and seals the packaging box without manual work which protects solid state disks, avoids doing damage, and improves production efficiency.

10 Claims, 16 Drawing Sheets

(51) Int. Cl.

| | |
|---|---|
| ***B65B 61/02*** | (2006.01) |
| ***B65B 61/20*** | (2006.01) |
| ***B65B 65/00*** | (2006.01) |
| ***B65B 25/00*** | (2006.01) |
| ***B65B 43/52*** | (2006.01) |

(52) U.S. Cl.
CPC ..... *B65B 43/52* (2013.01); *B65B 61/025* (2013.01); *B65B 61/207* (2013.01); *B65B 65/003* (2013.01); *B65B 2220/18* (2013.01)

(58) Field of Classification Search
CPC ..... B65B 43/265; B65B 43/52; B65B 57/14; B65B 61/025; B65B 61/207; B65B 65/003; B65B 2220/18; B31B 2120/402
USPC ..... 53/400, 135.1, 135.2, 136.1, 156, 157, 53/170, 175, 237, 238, 244, 251; 206/307; 493/93
See application file for complete search history.

(56) References Cited

U.S. PATENT DOCUMENTS 4,966,280 A * 10/1990 Bradford ..... B65D 5/48038 206/721
5,279,094 A * 1/1994 Odom et al. ..... B65B 51/065 53/139.1
6,264,034 B1 * 7/2001 Bacques et al. ..... B65D 5/5028 206/497
6,427,842 B1 * 8/2002 Green ..... B65D 5/0521 206/497
6,701,218 B2 * 3/2004 Koike et al. ..... G07F 17/0092 700/235
7,370,757 B2 * 5/2008 Scheid, Sr. et al. ... B65D 5/509 206/320
7,587,879 B2 * 9/2009 Guttinger et al. ..... B65B 5/101 53/169
2007/0187268 A1 * 8/2007 Djulaini et al. ..... B65D 81/113 206/307
2007/0209952 A1 * 9/2007 Yukawa ..... G11B 23/0236 206/307
2009/0078601 A1 * 3/2009 Lin et al. ..... G11B 33/0466 206/307
2010/0320276 A1 * 12/2010 Dreyer ..... B65B 61/025 235/494
2012/0083920 A1 * 4/2012 Suyama et al. ..... B65B 5/105 700/230
2012/0111763 A1 * 5/2012 Cummings ..... B65B 61/207 206/585
2013/0180935 A1 * 7/2013 Lee et al. ..... G06F 1/187 211/41.12

FOREIGN PATENT DOCUMENTS

JP 05213313 A * 8/1993
JP 06191507 A * 7/1994

* cited by examiner

120

231

238

235

SOLID STATE DISK PACKAGING LINE

RELATED APPLICATIONS

This application claims the benefit of priority to Chinese Patent Application No. 201810327190.6 filed on Apr. 12, 2018, which is hereby incorporated by reference in its entirety.

FIELD OF THE INVENTION

The present invention relates to a field of a packaging production line, and more particularly to a solid state disk packaging line.

BACKGROUND OF THE INVENTION

Solid state disks are quickly accepted by users and gradually replace mechanical hard disks due to compact size and high reading speed. Solid state disks are more resistant than the mechanical hard disks, light collisions do not cause data loss, and solid state disk has a longer service life than the mechanical hard disk, however, on the one hand, solid state disk is more expensive than the mechanical hard disk; on the other hand, once solid state disk is damaged, all data will be lost and cannot be retrieved. Thus, the solid state disks need to be securely packaged for shipping.

Since the solid state disks to be packaged have a variety of different specifications, it is necessary to confirm solid state disk specifications before packaging so that the solid state disks are matched with the product labels outside the packaging box.

Thus, it is necessary to provide an automatic solid state disk packaging line in order to avoid the problem of poor production efficiency, production being damaged, as well as product labels lacking agreement to solid state disk caused by manual packaging.

SUMMARY OF THE INVENTION

One objective of the present invention is to provide an automatic solid state disk packaging line, so as to avoid problems caused by manual packaging in the prior art, including solid state disk damage, poor production efficiency, and product labels mismatching with solid state disks.

To achieve the above objective, a solid state disk packaging line, for packaging solid state disks, includes a stacking tray conveying system, a packaging system, a packaging box conveying system, and a packaging box packaging system. The packaging system includes a packaging box loading device, a sealing bag loading device, and a packaging machine which are arranged linearly. Two sides of the packaging system, where is provided with the packaging machine, are connected with the stacking tray conveying system and the packaging box conveying system respectively. The packaging machine is adapted for receiving a stacking tray loaded with solid state disks and conveyed by the stacking tray conveying system, and loads the stacking tray into a packaging box, and then transfers the packaging box to the packaging box packaging system via the packaging box conveying system. And the packaging box with the stacking trays loaded therein is sealed by the packaging box packaging system.

In comparison with the prior art, the solid state disk packaging line of the present invention works by cooperating with the stacking tray conveying system, the packaging box conveying system, and the packaging box packaging system, thereby sealing the solid state disks into a packaging box. The solid state disk packaging line is highly automated without manual operation, which reduces the labor. In addition, products with different specifications can be packaged at the same time to significantly increase production efficiency. Meanwhile, the solid state disk packaging line can avoid possible damages to the solid state disk brought by the manual packaging.

Preferably, the stacking tray conveying system includes a tray loading device, a stacking tray loading device, a conveying device, and a tray unloading device which are arranged linearly, and further includes a plurality of trays adapted for receiving the stacking tray and moving among the tray loading device, the stacking tray loading device, the conveying device, and the tray unloading device so as to load the stacking tray.

Preferably, the tray is provided with a tray fixed identifier, and the stacking tray conveying system further includes an identifier placer which is adapted for placing a stacking tray moving identifier on the tray and tracing the stacking tray information by identifying the tray fixed identifier and the corresponding stacking tray moving identifier. It can be understood that a limited number of trays cyclically moves and are reused. In order to uniquely and accurately identify the stacking tray with the solid state disks, another stacking tray moving identifier corresponding to the stacking tray is provided. However, when the tray is loaded with the stacking tray, the stacking tray moving identifier may be shielded and unidentifiable. Therefore, by connecting the tray fixed identifier with the stacking tray moving identifier, the corresponding stacking tray information can be obtained by scanning the tray fixed identifier while the stacking tray is transferred.

Preferably, the solid state disk packaging line further includes a label printing mechanism for printing a product label. The product label is attached to an outside of the packaging box, and the label printing mechanism communicates with product information base and acquires the stacking tray information so as to print out the product label.

Specifically, the conveying device includes an upper conveying passage and a lower conveying passage. The tray loading device and the tray unloading device respectively drive the tray to move between the upper conveying passage and the lower conveying passage to convey the tray circularly. Thus, the stacking tray loading device and the stacking tray unloading device at two ends of the conveying device can drive the tray to move between the upper and lower conveying passage, so that the tray can move circularly in the conveying device. The stacking tray is loaded by the upper conveying passage, and the tray is returned by the lower conveying passage to transfer the stacking tray to the packaging system.

Preferably, the packaging machine includes a packaging box conveying mechanism, a labeling mechanism, a partition loading mechanism, a robot mechanism, a desiccant loading mechanism, and a sealing bag heat sealing mechanism, and the packaging machine has a packaging position. A conveying track of the packaging box conveying mechanism passes through the packaging position and the sealing bag heat sealing mechanism. Loading positions of the partition loading mechanism, the robot mechanism and the desiccant loading mechanism are located above the packaging position. The robot mechanism is configured to transfer the stacking tray to the packaging box located at the loading position, and the partition loading mechanism and the desiccant loading mechanism respectively place a partition and desiccant in the packaging box. The sealing bag is heat sealed through the sealing bag heat sealing mechanism and then enters the packaging box conveying system.

Specifically, the partition loading mechanism, the desiccant loading mechanism, and the sealing bag heat sealing mechanism are all located above the packaging machine, and a conveying track of the packaging box conveying mechanism is located beneath the partition loading mechanism, the desiccant loading mechanism, and the sealing bag heat sealing mechanism.

Specifically, the desiccant loading mechanism includes a vibrating loading tray, and a desiccant conveying belt connecting the vibrating loading tray and the packaging position.

Preferably, the stacking tray conveying system and the packaging system are respectively provided with a robot for receiving the stacking tray, and the robot includes a lifting finger for lifting the stacking tray and a pushing finger for pressing down the stacking tray.

Preferably, the packaging box packaging system includes a scanning device, a sealing device, a weighing device, and a sorting mechanism which are arranged in turn.

Preferably, the stacking tray conveying system and the packaging box conveying system are arranged linearly, and the packaging system and the packaging box packaging system are disposed perpendicularly to the stacking tray conveying system and the packaging box conveying system, and the packaging system and the packaging box packaging system are located on a same side of the stacking tray conveying system and the packaging box conveying system.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

A distinct and full description of the technical solution of the present invention will follow by combining with the accompanying drawings.

Figure 1:
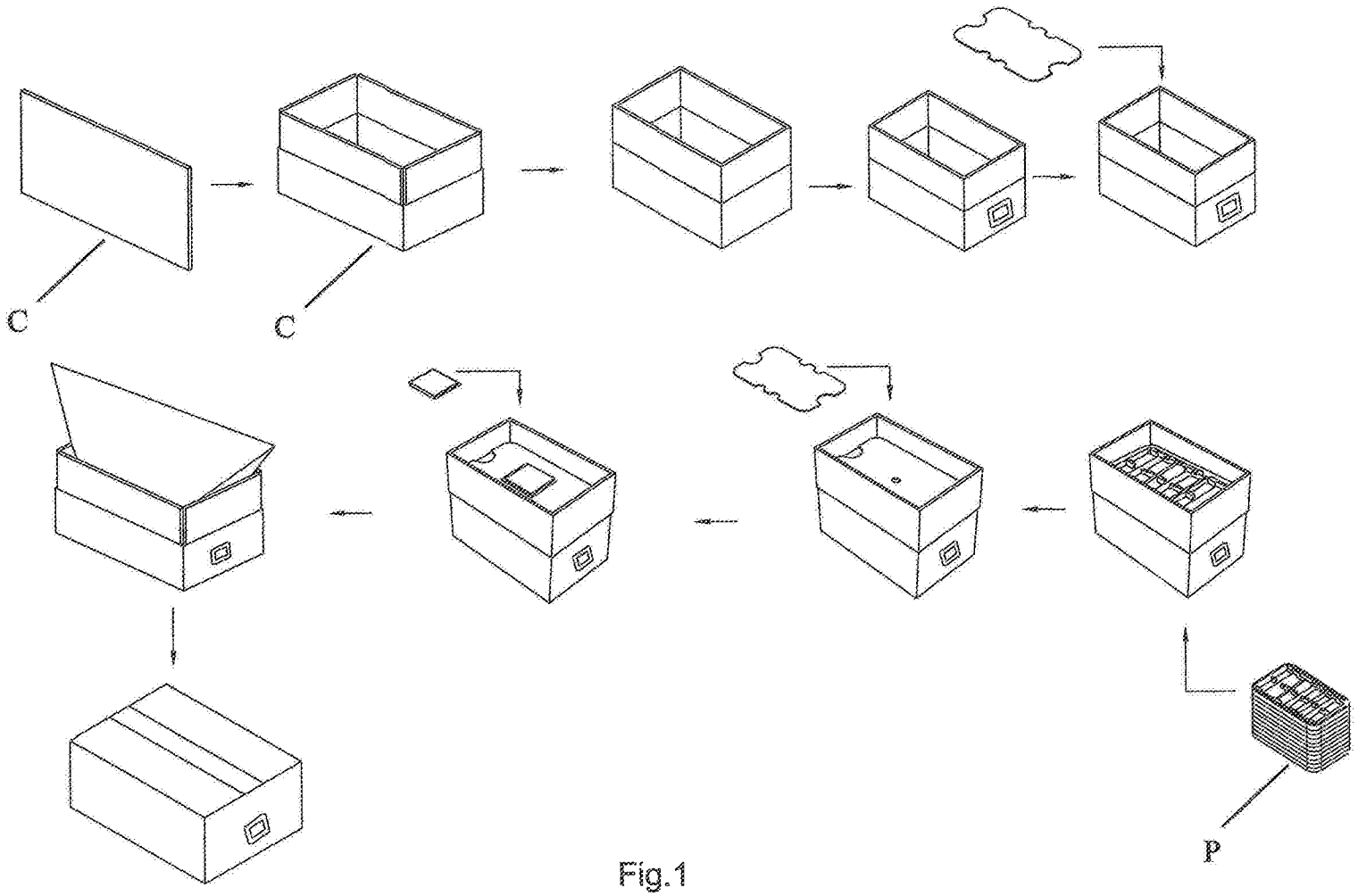
FIG. 1 is a schematic diagram showing a packaging process of a solid state disk according to the present invention.

Referring to FIG. 1, the packaging process of solid state disks includes: unfolding a packaging box C; inserting a sealing bag into the packaging box C; marking an identification code on an outer side of the packaging box C; putting a lower partition in the sealing bag; putting the stacking tray P into the sealing bag; putting an upper partition and desiccant in the sealing bag; sealing the sealing bag; and packaging the packaging box C.

A solid state disk packaging line is used for packaging solid state disks, which includes the whole packaging steps above mentioned so as to avoid quality problem caused by manual operation, and at the same time improving production efficiency.

Figure 2:
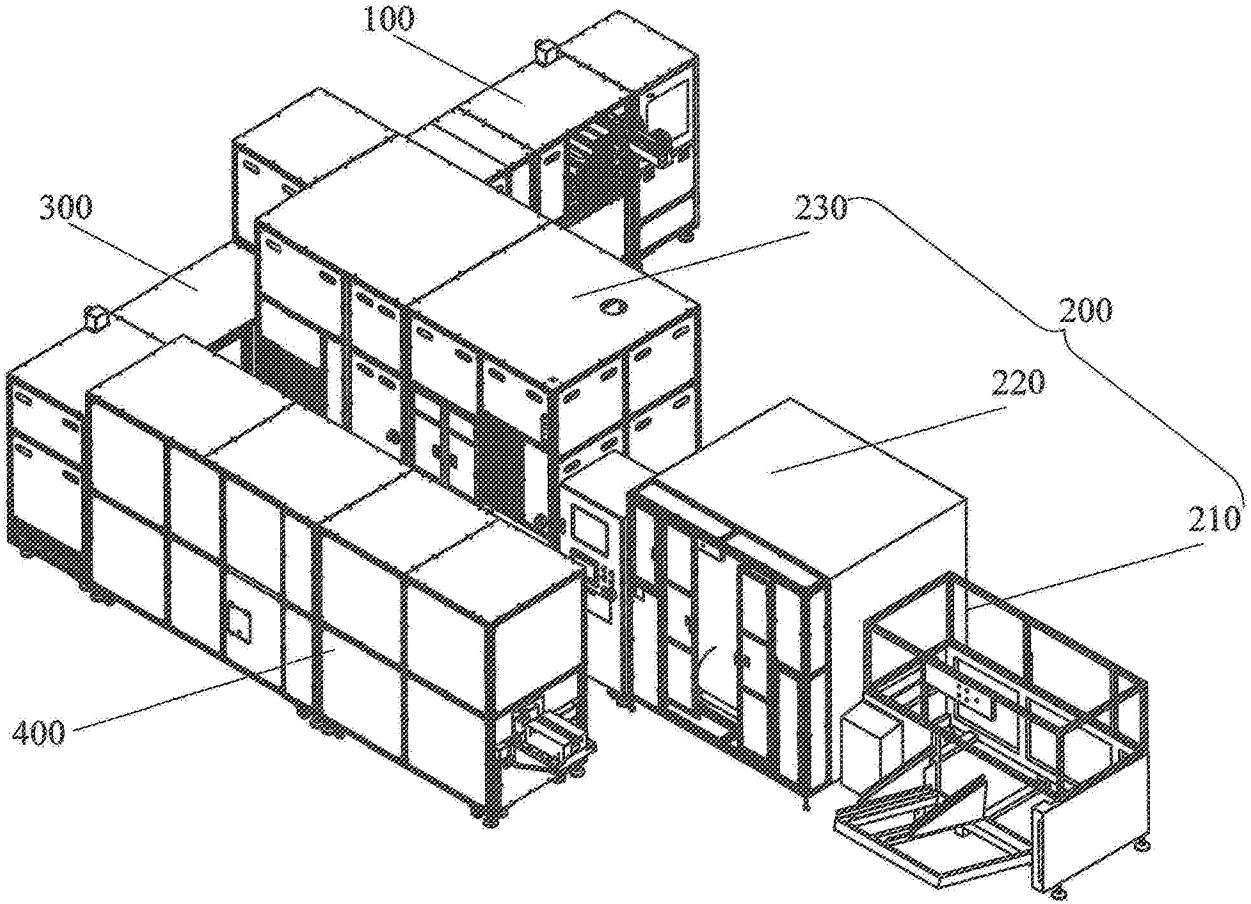
FIG. 2 is a perspective view of a solid state disk packaging line according to the present invention.

As shown in FIG. 2, a solid state disk packaging line includes a stacking tray conveying system 100, a packaging system 200, a packaging box conveying system 300, and a packaging box packaging system 400. The packaging system 200 includes a packaging box loading device 210, a sealing bag loading device 220, and a packaging machine 230 which are arranged linearly. Two sides of the packaging system 200, where is provided with the packaging machine 230, are connected with the stacking tray conveying system 100 and the packaging box conveying system 300 respectively. The packaging machine 230 is adapted for receiving a stacking tray P with solid state disks and conveyed by the stacking tray conveying system 100, loads the stacking tray P into the packaging box C, and then transfers the packaging box C to the packaging box packaging system 400 via the packaging box conveying system 300. And the packaging box C with the stacking trays P loaded therein is sealed by the packaging box packaging system 400. By combination with FIGS. 3-16, more details are described as follows.

Figure 3:
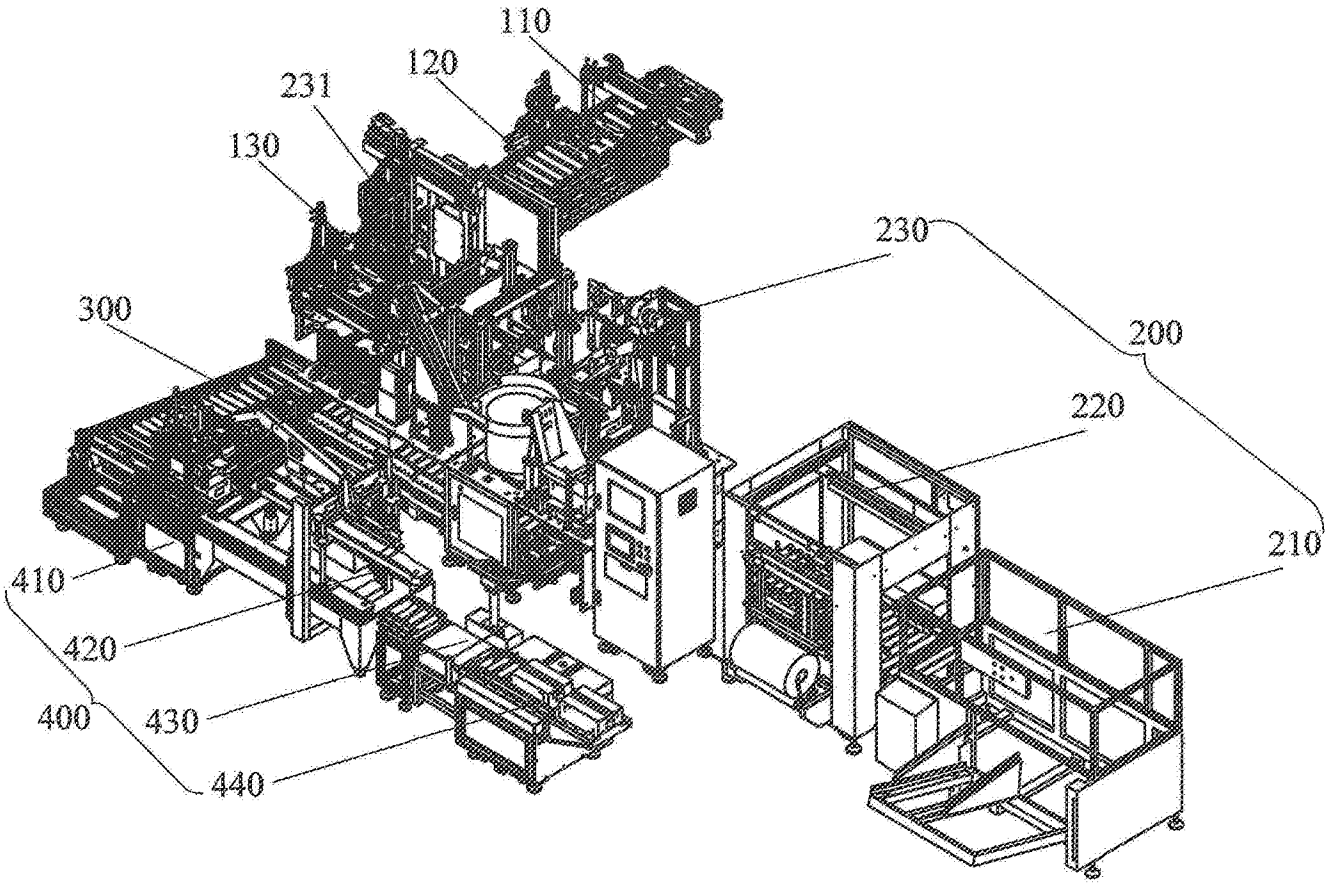
FIG. 3 is a perspective view of an internal structure of the solid state disk packaging line after the outer casing is removed according to the present invention.

As shown in FIGS. 2 and 3, the stacking tray conveying system 100 and the packaging box conveying system 300 are arranged linearly, and the packaging system 200 and the packaging box packaging system 400 are disposed perpendicularly to the stacking tray conveying system 100 and the packaging box conveying system 300. The packaging system 200 and the packaging box packaging system 400 are located on the same side of the stacking tray conveying system 100 and the packaging box conveying system 300. Overall arrangement of the solid state disk packaging line is similar to an "F" shape. The stacking tray P to be loaded, the packaging box C, the sealing bag, and the packaged packaging box C to be unloaded, are respectively located at each end of the "F" shape, so it is convenient to load the tray and easy to operate.

Further, the solid state disk packaging line further includes a solid state disk bagging system (not shown) which can put a single solid state disk into the sealing bag and put it into the stacking tray to obtain a stacking tray P for packaging. The solid state disk bagging system can be disposed at the other end of the stacking tray conveying system 100, so that overall arrangement of the solid state disk packaging line is similar to an "E" shape.

It can be understood, the solid state disks in each stacking tray have the same specifications, but the solid state disks in different stacking trays have various specifications. Therefore, before packaging the stacking tray, it is necessary to confirm the specification of the solid state disk loaded, and monitor the corresponding stacking tray at any time to ensure that the product label attached to the outside of the packaging box C is corresponding to the solid state disk loaded.

For the stacking tray conveying system 100, as shown in FIGS. 4-8, more details are described as follows.

Figure 4:
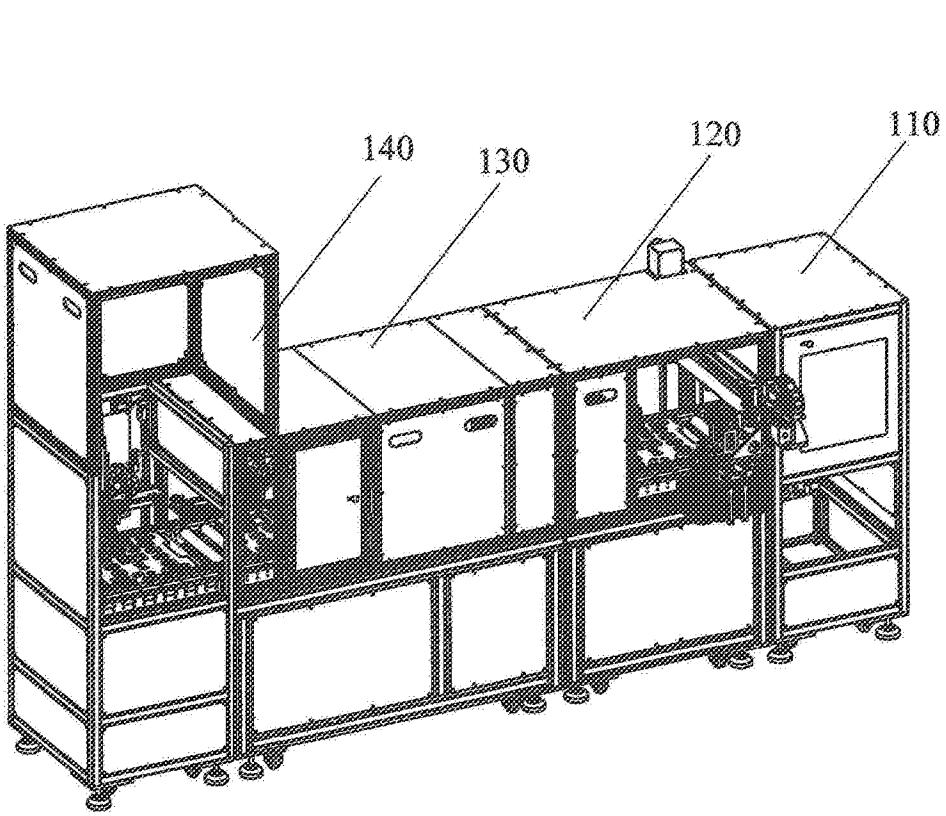
FIG. 4 is a perspective view of a stacking tray conveying system according to the present invention.

As shown in FIG. 4, the stacking tray conveying system 100 includes a tray loading device 110, a stacking tray loading device 120, a conveying device 130, and a tray unloading device 140 which are arranged linearly, and further includes a plurality of trays 150 adapted for receiving the stacking tray P and moving among the tray loading device 110, the stacking tray loading device 120, the conveying device 130, and the tray unloading device 140 so as to load the stacking tray P.

Figure 6:
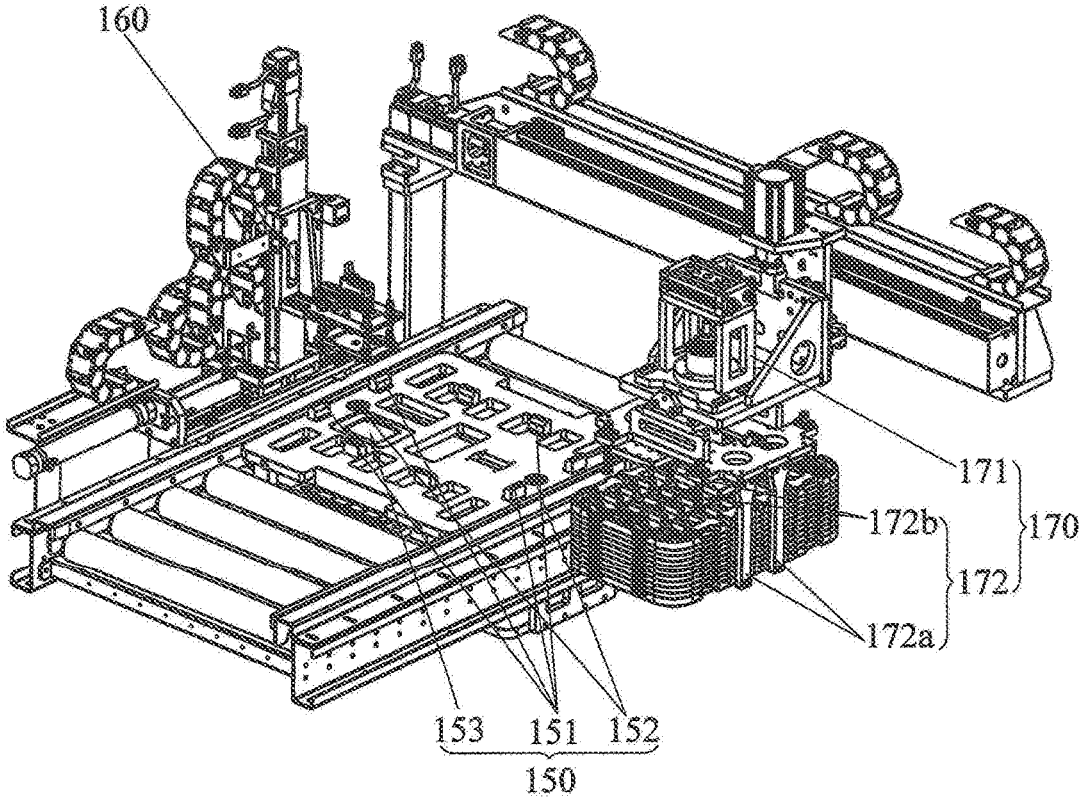
FIG. 6 is a perspective view of an internal structure of the stacking tray loading device according to the present invention.

The tray 150 is provided to ensure that the stack tray P is transferred by the stacking tray conveying system 100. Specifically, as shown in FIG. 6, a plurality of flat trays 150 carry the stacking tray P and convey it through the stacking tray loading device 120, the conveying device 130, and the tray unloading device 140 so as to load the stacking tray P. Further, a plurality of positioning blocks 151 are arranged on an upper side of the tray 150. When the stacking tray P is placed on the upper side of the tray 150, a plurality of positioning blocks 151 are able to limit the stacking tray P. The tray 150 is further provided with a positioning hole 152 and cooperates with a positioning pin on the stacking tray conveying system 100 by the positioning hole 152 to further limit the tray 150 stably.

Figure 7:
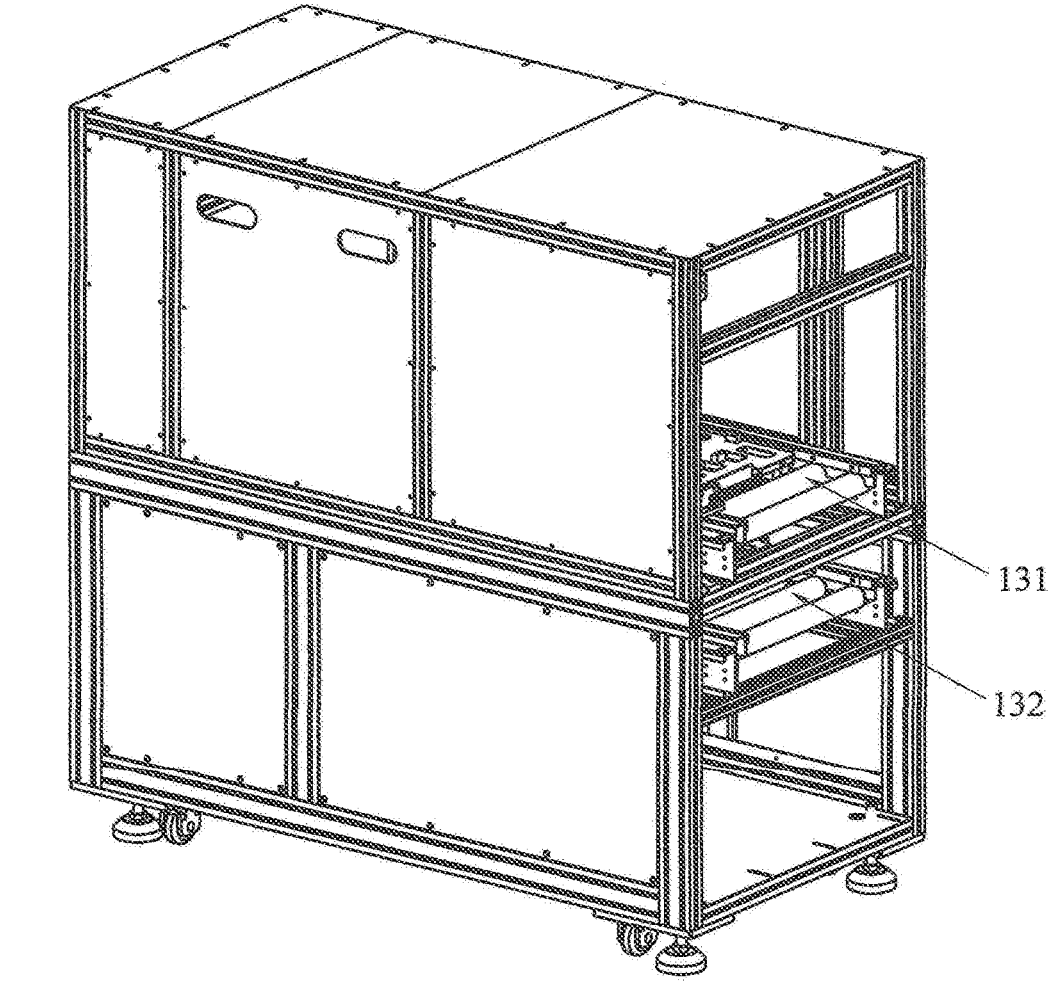
FIG. 7 is a perspective view of a conveying device according to the present invention.

Specifically, as shown in FIG. 7, the conveying device 130 includes an upper conveying passage 131 and a lower conveying passage 132. As shown in FIG. 4, the tray loading device 110 and the tray unloading device 140 located on two ends of the stacking tray conveying system 100 respectively drive the tray 150 to move between the upper conveying passage 131 and the lower conveying passage 132 to convey the tray 150 circularly. After the tray 150 at the stacking tray loading device 120 receives the stacking tray P, the tray 150 with the stacking tray P is moved along the upper conveying passage 131 to the tray unloading device 140 driven by the conveying device 130; after the stacking tray P is loaded to the packaging system 200, the empty tray 150 is moved downward along the lower conveying passage 132 to the tray loading machine 110 driven by the tray unloading device 140; and the empty tray 150 is lifted upwards by the tray loading machine 110 and returns to the stacking tray loading device 120, and the empty tray 150 is flush with the upper conveying passage 131 to receive the stacking tray P.

Figure 8:
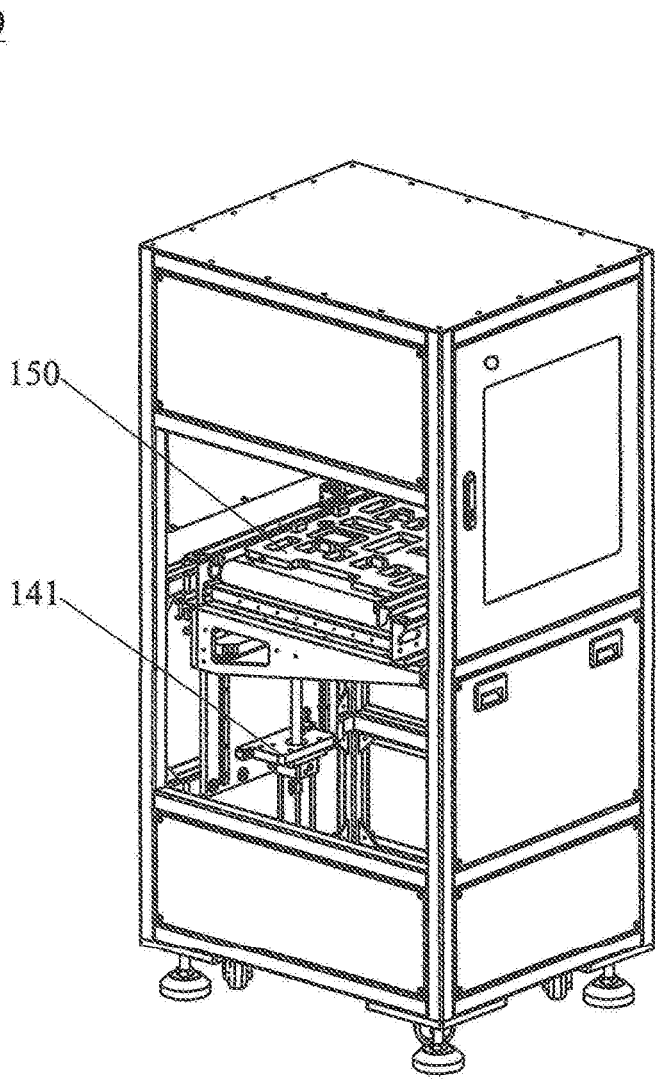
FIG. 8 is a perspective view of a tray unloading device according to the present invention.
Figure 9:
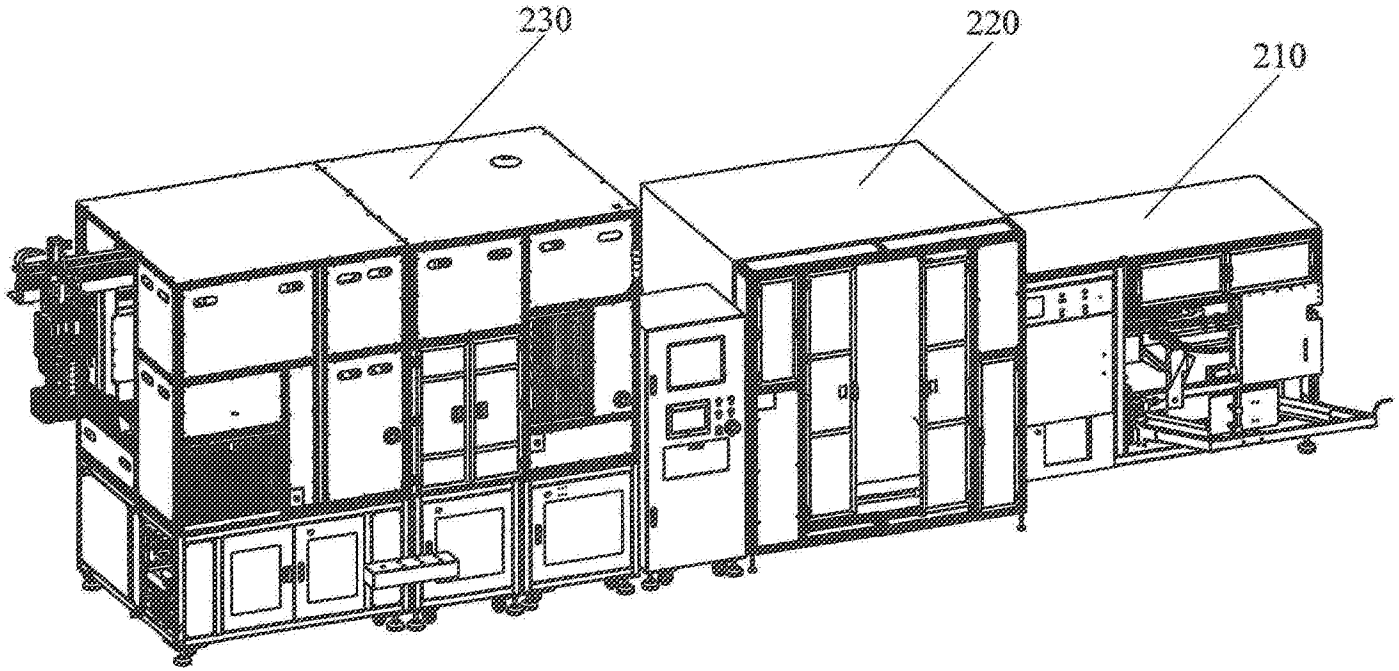
FIG. 9 is a perspective view of a packaging system according to the present invention.

In this embodiment, as shown in FIG. 7, the conveying device 130 is specifically a roller conveying device, and the flat tray 150 is provided for smoothly transferring the stacking tray P. As shown in FIG. 8, the flat tray 150 cooperates with the tray unloading device 140 having a vertical drive mechanism 141, which drives the tray 150 to move vertically to a position flush with the lower conveying passage 132 to make the tray 150 to move circularly.

Figure 5:
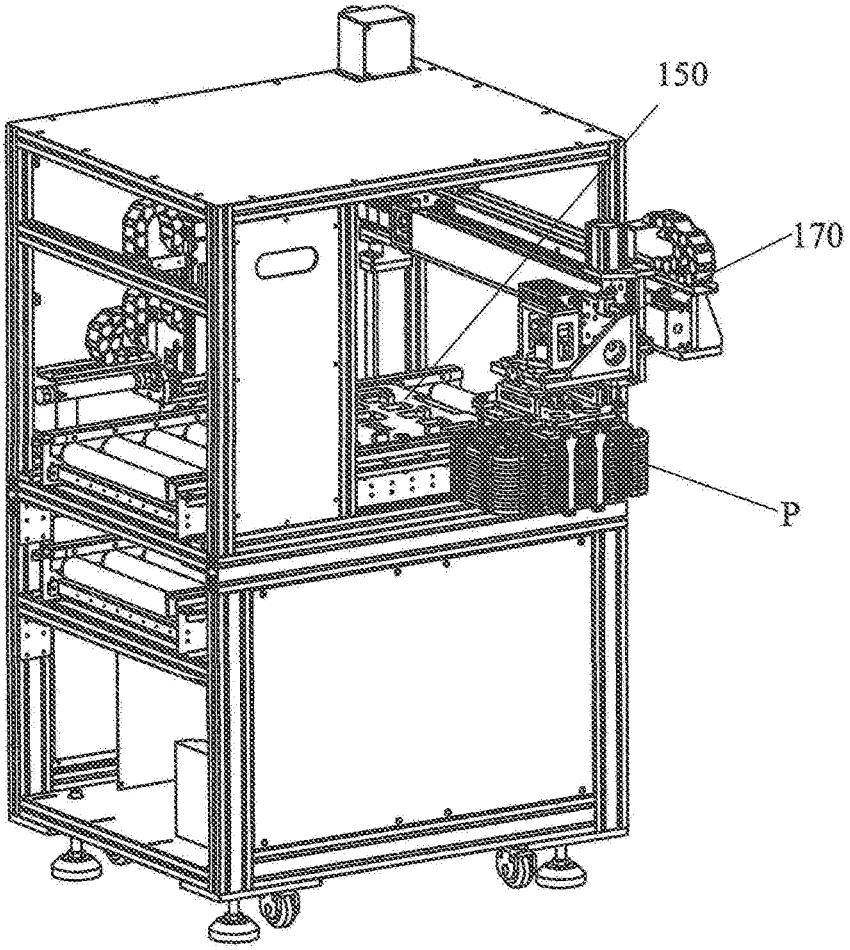
FIG. 5 is a perspective view of a stacking tray loading device according to the present invention.

Preferably, referring to FIGS. 5 and 6, the tray 150 is provided with a tray fixed identifier, and the stacking tray conveying system 100 further includes an identifier placer which is adapted for placing a stacking tray moving identifier on the tray 150 and tracing the stacking tray information by identifying the tray fixed identifier and the corresponding stacking tray moving identifier. Specifically, a tray fixed identifier (not shown) is fixed to a bottom of each tray 150 and the tray fixed identifier is in one-to-one correspondence with the tray 150. An upper side of each tray 150 is provided with a label placement position 153, and the stacking tray loading device 120 is further provided with the identifier placer 160. The identifier placer 160 places the stacking tray moving indicator onto the label placement position 153 on the upper side of the tray 150 when the tray 150 is moved to the front of the identifier placer 160 and waits to be loaded.

It can be understood that the trays 150 are cyclically moved to reuse in the packaging line. By connecting the tray fixed identifier with the stacking tray moving identifier, while the stacking tray P is transferred in the stacking tray conveying system 100, the tray fixed identifier is read in time to obtain the stacking tray moving identifier and accurately identify the corresponding stacking tray P, and it is convenient to trace and identify the stacking tray P information. When the stacking tray P leaves the tray (namely leaves the stacking tray conveying system 100 and reaches to the packaging system 200), the tray fixed identifier and the stacking tray moving identifier are disconnected. Then the tray fixed identifier follows the tray, the tray returns to carry another stacking tray P, and the tray fixed identifier is again bundled with its corresponding stacking tray moving identifier. For the disconnected stacking tray moving identifier, when the corresponding stacking tray P leaves the stacking tray conveying system 100 to the packaging system 200, the stacking tray information will be automatically transferred to the packaging system 200 so that the stacking tray P is always monitored. Specifically, the identifier placer 160 is disposed outside the loading position of the stacking tray loading device 120, and sucking assembly of the identifier placer 160 can remove the stacking tray moving identifier at the label placement position 153, and place the stacking tray moving identifier corresponding to the next stacking tray P at the label placement position 153. Preferably, the identifier placer 160 is able to print the stacking tray moving identifier; the stacking tray moving identifier is printed, removed by the sucking assembly, and placed in the label placement position 153. In this embodiment, the stacking tray moving identifier and the tray fixed identifier are barcodes. In other embodiments, the stacking tray moving identifier and the tray fixed identifier may also be two-dimensional codes or other identification marks.

Referring to FIG. 5 and FIG. 6, the stacking tray loading device 120 is also provided with a pick-place robot 170, which is used for grasping the stacking tray P from the solid state disk bagging system or other mechanism and placing it at the loading position of the stacking tray loading device 120. The pick-place robot 170 includes a robot 172 for gripping the stacking tray P and a drive mechanism 171 for driving the robot to move. In order to ensure that the stacked stacking tray P does not shift while transferred: the robot 172 includes a lifting finger **172*a* for lifting the stacking tray P and a pushing finger 172*b* for pressing the stacking tray P downward. The pushing finger 172*b* cooperates with the lifting finger 172*a* to position stably the stacking tray P. In this embodiment, the pushing finger 172*b*** is specifically a pin driven by an elastic member.

For the packaging system 200, by combination with FIGS. 9-16, more details are described as follows.

The packaging system 200 includes a packaging box loading device 210, a sealing bag loading device 220, and a packaging machine 230 which are arranged linearly. Two sides of the packaging system 200, where is provided with the packaging machine 230, are connected with the stacking tray conveying system 100 and the packaging box conveying system 300 respectively. The packaging machine 230 is adapted for receiving a stacking tray P loaded with solid state disks and conveyed by the stacking tray conveying system 100, loading the stacking tray P into a packaging box C, and then transferring the packaging box C to the packaging box packaging system 400 via the packaging box conveying system 300.

It can be understood, the packaging box loading device 210 unfolds the packaging box C, and the sealing bag loading machine 220 wraps the sealing bag into the packaging box C and folds the sealing bag mouth outside the packaging box C mouth. This structure is relatively simple and will not be described in detail here. The structure of the packaging machine 230 will be described in detail below.

Figure 10:
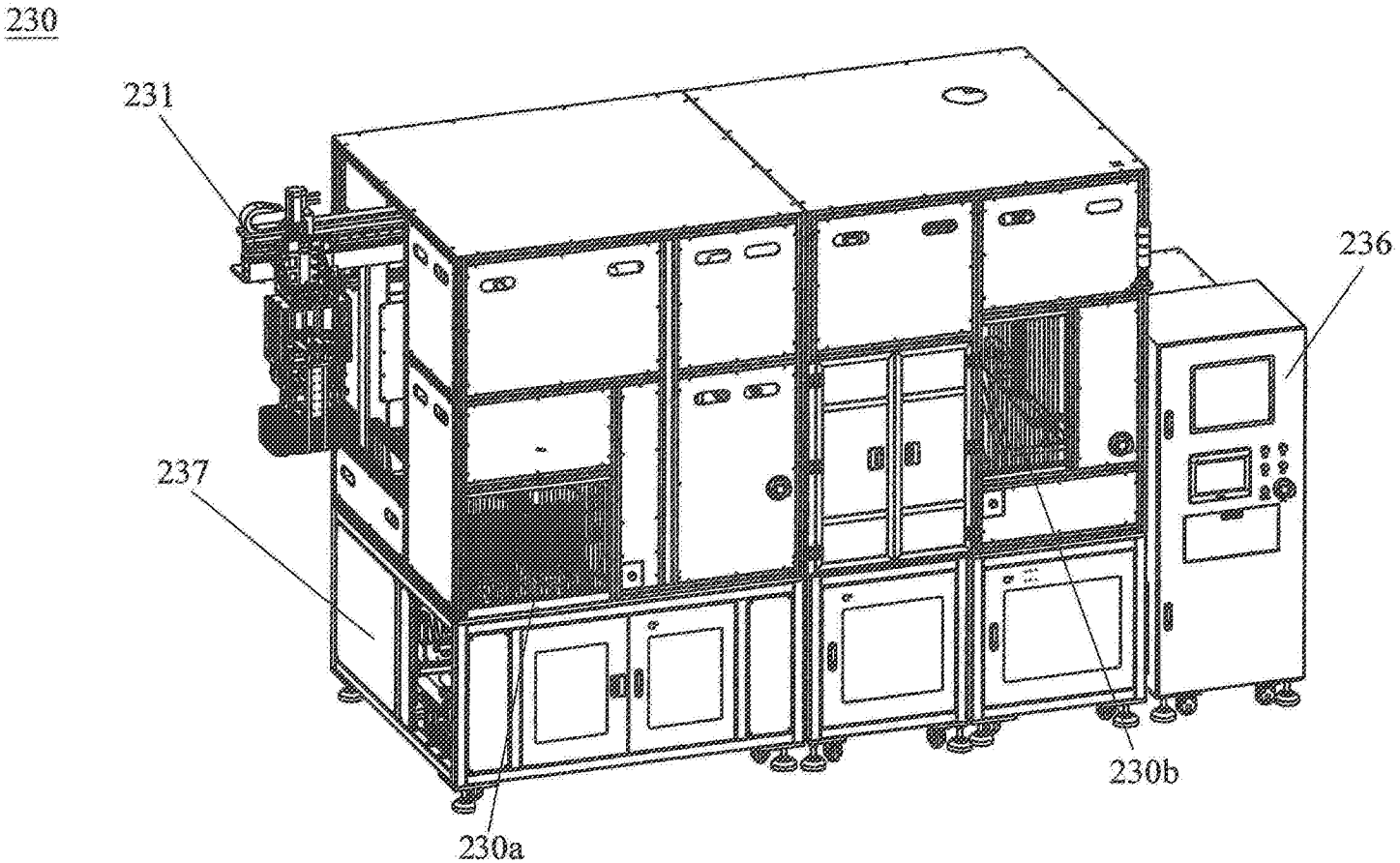
FIG. 10 is a perspective view of a packaging machine according to the present invention.
Figure 11:
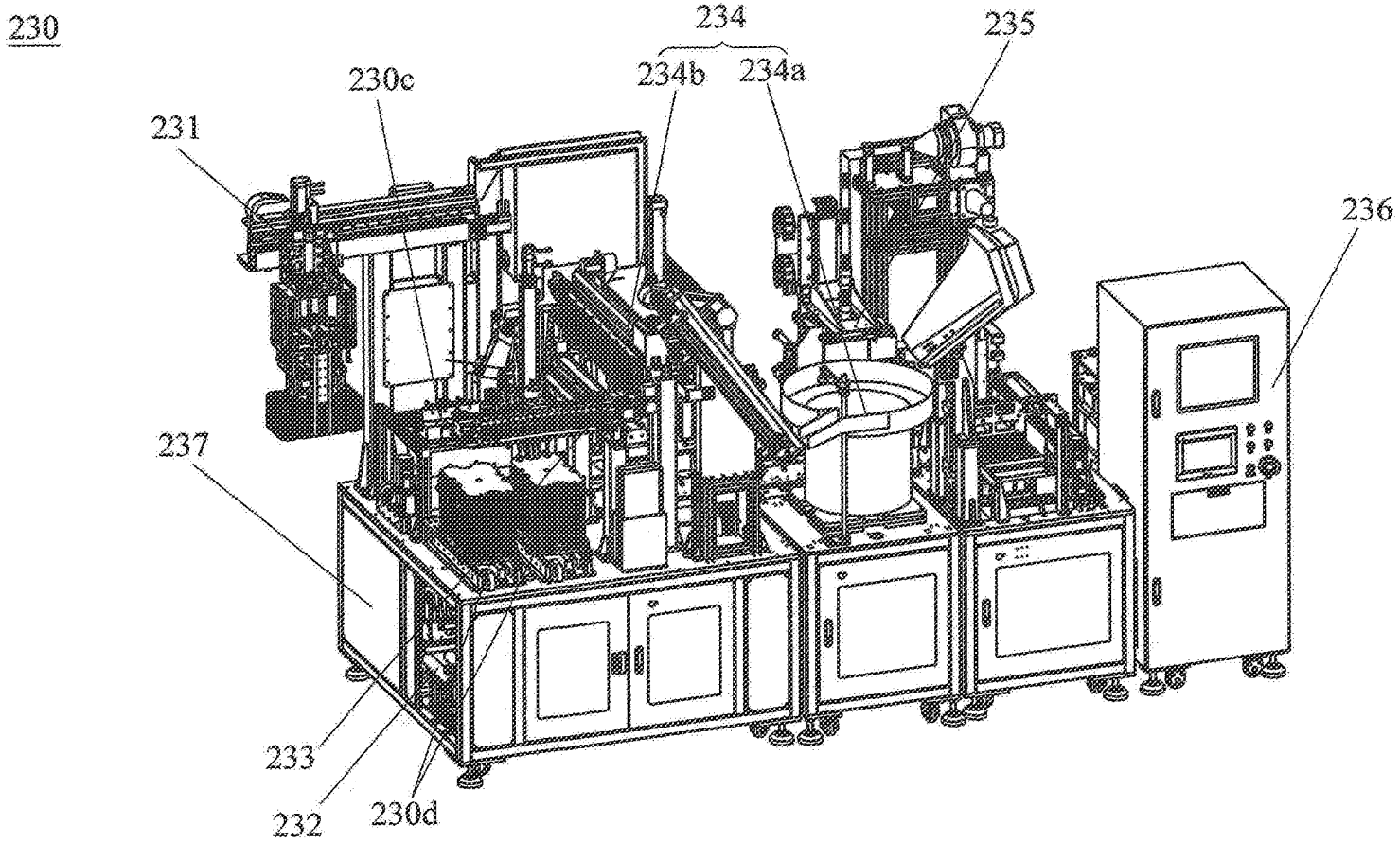
FIG. 11 is a perspective view of an internal structure of the packaging machine according to the present invention.
Figure 12:
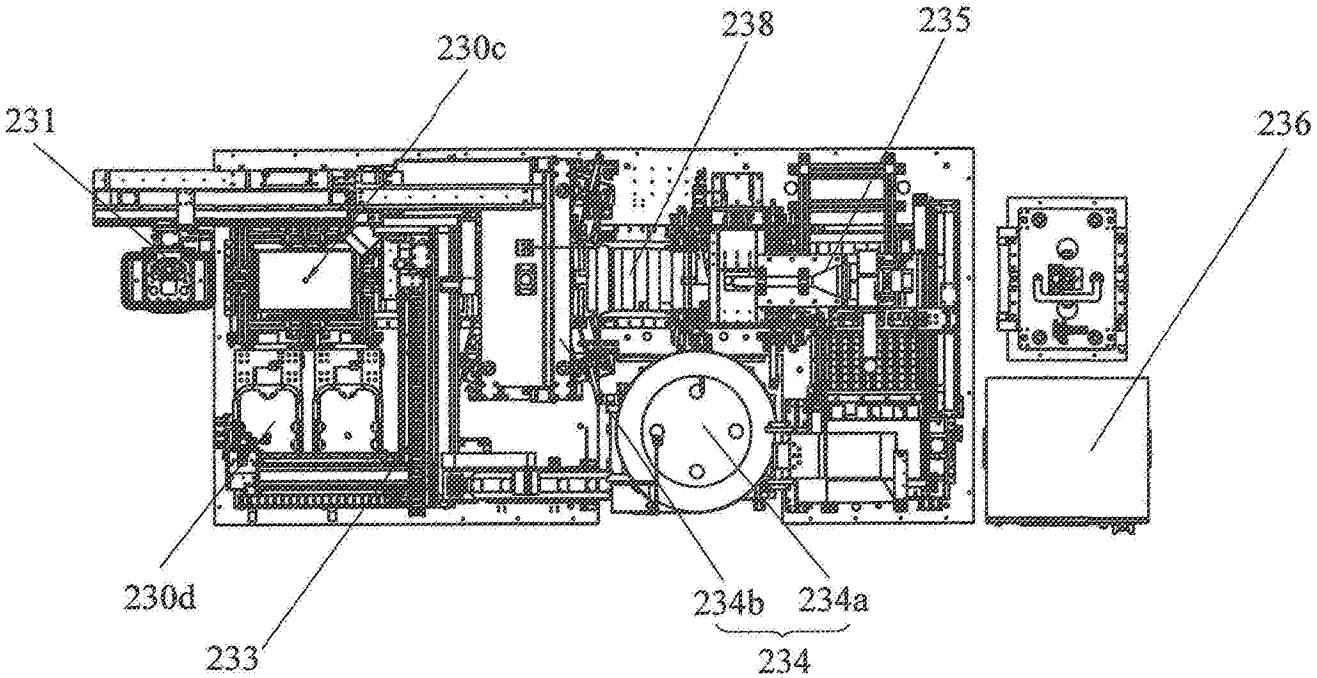
FIG. 12 is a top view of the internal structure of the packaging machine according to the present invention.

As shown in FIGS. 10-12, the packaging machine 230 includes a robot mechanism 231, a packaging box conveying mechanism 232, a partition loading mechanism 233, a desiccant loading mechanism 234, a sealing bag heat sealing mechanism 235, an electric control box 236, and a labeling mechanism (not shown), and the packaging machine 230 has a packaging position 230*c*. A conveying track of the packaging box conveying mechanism 232 passes through the packaging position 230*c* and the sealing bag heat sealing mechanism 235. Loading positions of the partition loading mechanism 233 and the desiccant loading mechanism 234 are located above the packaging position 230*c*. The robot mechanism 231 is configured to transfer the stacking tray P to the packaging box C located at the loading position, and the partition loading mechanism 233 and the desiccant loading mechanism 234 respectively place a partition and desiccant in the packaging box C. The sealing bag is heat sealed by the sealing bag heat sealing mechanism 235 and then enters the packaging box conveying system 300.

In order to identify and position the stacking tray P: the solid state disk packaging line further includes a label printing mechanism (not shown) for printing a product label. The product label is attached to outside of the packaging box C, and the label printing mechanism communicates with product information base and acquires the stacking tray information so as to print out the product label. The label printing mechanism may be disposed near the packaging position 230*c*, and the labeling mechanism (not shown) which attaches the product label to outside of the packaging box C is disposed at the packaging position 230*c*. After the packaging box C loaded with the stacking tray P is loaded to the packaging position 230*c* by the robot mechanism 231, the label printing mechanism cooperating with the labeling mechanism attaches the corresponding product label to the outer wall of the packaging box C to identify the stacking tray P seamlessly. Subsequently, although the stacking tray P is loaded in the packaging box C, the information of the solid state disk loaded inside the stacking tray P can be known by scanning the product label on the outer wall of the packaging box C. In this embodiment, the product label printed by the label printing mechanism is also a barcode. Specifically, the packaging machine 230 has a frame 237. The front or rear side of one end of the frame 237 is connected to the tray unloading device 140 to receive the stacking tray P, and the rear or front side is connected to the packaging box conveying system 300 for transferring the packaging box C processed by the packaging machine 230 to the packaging box packaging system 400. The other end of the frame 237 away from the tray unloading device 140 and the packaging machine 230 is connected with the sealing bag loading device 220 to receive the packaging box C with the sealing bag.

The partition loading mechanism 233, the desiccant loading mechanism 234, and the sealing bag heat sealing mechanism 235 are respectively disposed on the upper side of the frame 237. In order to put the partition and the desiccant in the packaging box C easily via the partition loading mechanism 233 and the desiccant loading mechanism 234, the packaging position can be set to be shorter and lower than the partition loading mechanism 233 and the desiccant loading mechanism 234. The electric control box 236 is disposed on the outer side of the frame 237.

Preferably, in this embodiment, in order to ensure that the partition loading mechanism 233, the desiccant loading mechanism 234, and the sealing bag heat sealing mechanism 235 are placed in the limited space of the frame 237, the transfer passage of the packaging box conveying mechanism 232 is not limited to horizontal, but can also be in the vertical direction. Specifically, in this embodiment, the partition loading mechanism 233 and the desiccant loading mechanism 234 are disposed along one long side of the frame 237, and the sealing bag heat sealing mechanism 235 and the packaging position 230*c* are located at the other long side of the frame 237. The packaging box conveying mechanism 232 with the sealing bag passes through the sealing bag heat sealing mechanism 235 from below to the packaging position 230*c*; after the partition, the stacking tray P, the partition and the desiccant are sequentially placed in the packaging box C, the packaging box C is moved up to the right driven by packaging box conveying mechanism 232 to the sealing bag heat sealing mechanism 235, so that the sealing bag heat sealing mechanism 235 seals the sealing bag; then the packaging box C is moved to the other long side of the frame 237 driven by the packaging box conveying mechanism 232, and passes through the partition loading mechanism 233 and the desiccant loading mechanism 234 so as to transfer the packaging box C to the packaging box conveying system 300.

More specifically, referring to FIGS. 11 and 12, a short side of the frame 237 faces the stacking tray conveying system 100 and the packaging box conveying system 300. In the short sides of the frame 237, a short side adjacent to the stacking tray conveying system 100 is provided with a packaging position 230*c*, and a short side close to the packaging box conveying system 300 is provided with a partition receiving position 230*d*. The partition loading mechanism 233 is disposed above the partition receiving position 230*d*. The sucking assembly of the partition loading mechanism 233 can move the partition at the partition receiving position 230*d* to the packaging box C at the packaging position 230*c* to load the partition.

Referring to FIG. 11 and FIG. 12, the desiccant loading mechanism 234 is disposed along the long side of the frame 237 with respect to the partition receiving position 230*d* and the partition loading mechanism 233. The desiccant loading mechanism 234 includes a vibrating loading tray 234*a* and the desiccant conveying belt 234*b* connected to the vibrating loading tray 234*a* and the packaging position 230*c*. The vibrating loading tray 234*a* is far from the packaging position 230*c*, and the desiccant in the vibrating loading tray 234*a* is passed through the desiccant conveying belt 234*b* and transferred to the packaging position 230*c*. As shown in FIG. 10, a partition loading mouth 230*a* is formed in the corresponding partition receiving position 230*d* of the outer casing of the packaging box conveying system 230. The stacked partitions can be placed into the partition receiving position 230*d* from the partition loading mouth 230*a*. The desiccant loading mechanism 234 of the outer casing of the packaging box conveying system 230 is further provided with a desiccant loading mouth 230*b*, and a plurality of small bag desiccants are placed in the desiccant loading mechanism 234 via the desiccant loading mouth 230*b*.

Figure 13:
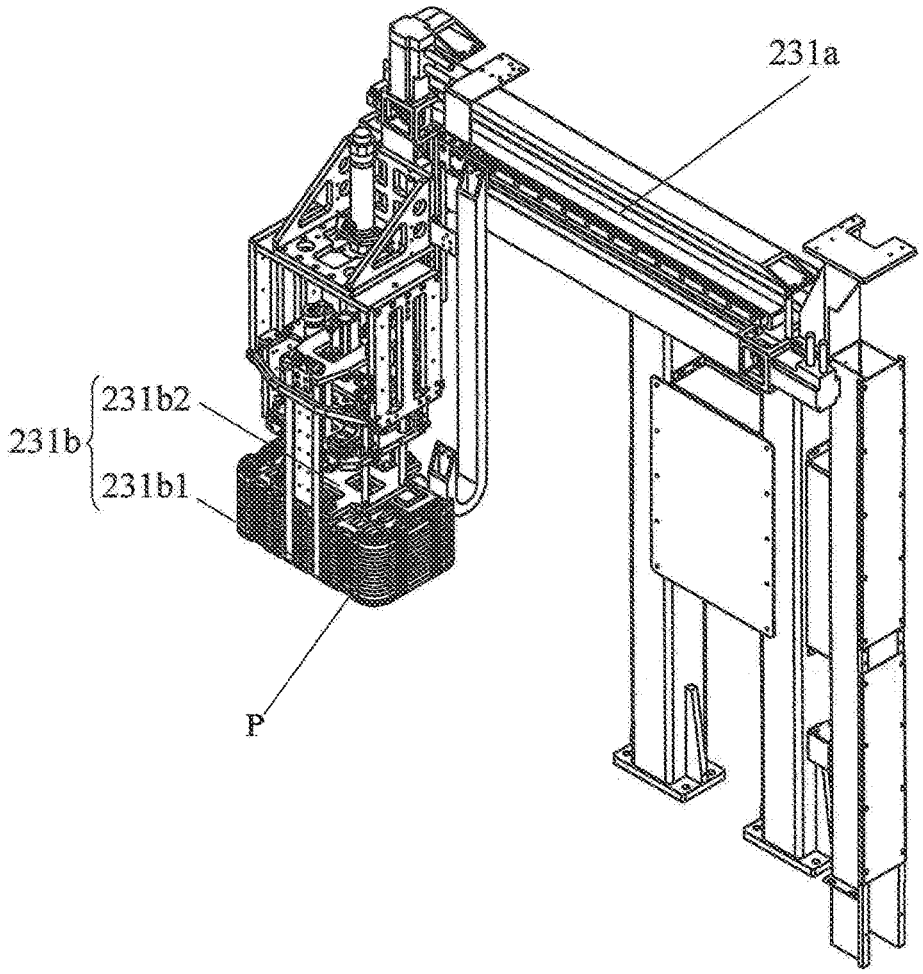
FIG. 13 is a perspective view of a robot mechanism according to the present invention.

As shown in FIG. 13, the robot mechanism 231 is disposed on one side of the packaging position 230*c*, and the robot mechanism 231 also includes a robot 231*b* for gripping the stacking tray P and a drive mechanism 231*a* for driving the robot to move between the tray unloading device 140 and the packaging position 230*c*. Specifically, the robot 231*b* includes a lifting finger 231*b*1 for lifting the stacking tray P and a pushing finger 231*b*2 for pressing down the stacking tray P, and the pushing finger 231*b*2 cooperates with the lifting finger 231*b*1 to position stably the stacking tray P. It can be understood, since the position of the packaging position 230*c* is low, in order to smoothly transfer the stacking tray P into the packaging box C, the vertical track stroke of the robot mechanism 231 can be set longer. Thus, the difference between the robot 231*b* and the robot 172 is that the pushing finger 231*b*2 of the robot 231*b* is specifically an elastic abutment block driven by the cylinder.

Figure 14:
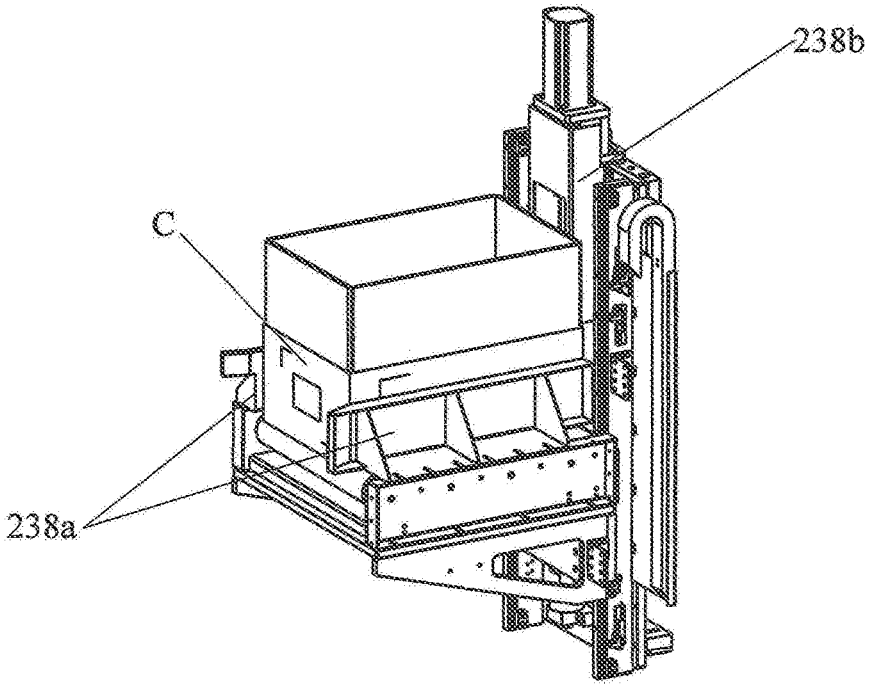
FIG. 14 is a perspective view of a packaging box positioning mechanism according to the present invention.

Further, as shown in FIG. 14, an adjustment unit 238 is disposed at the packaging position 230*c*, and the adjustment unit 238 adjusts the packaging box C by the adjustment members 238*a* on the left and right sides, so that the packaging box C is placed in a position facing the stacking tray P and the robot mechanism 231. Further, the adjustment unit 238 further includes a vertical drive member 238*b*, by which the vertical drive member drives the packaging box C to vertically move to receive the stacking tray P. The vertical drive member 238*b* can also lift vertically the packaging box C to transfer the packaging box C to the sealing bag heat sealing mechanism 235 for sealing.

Figure 15:
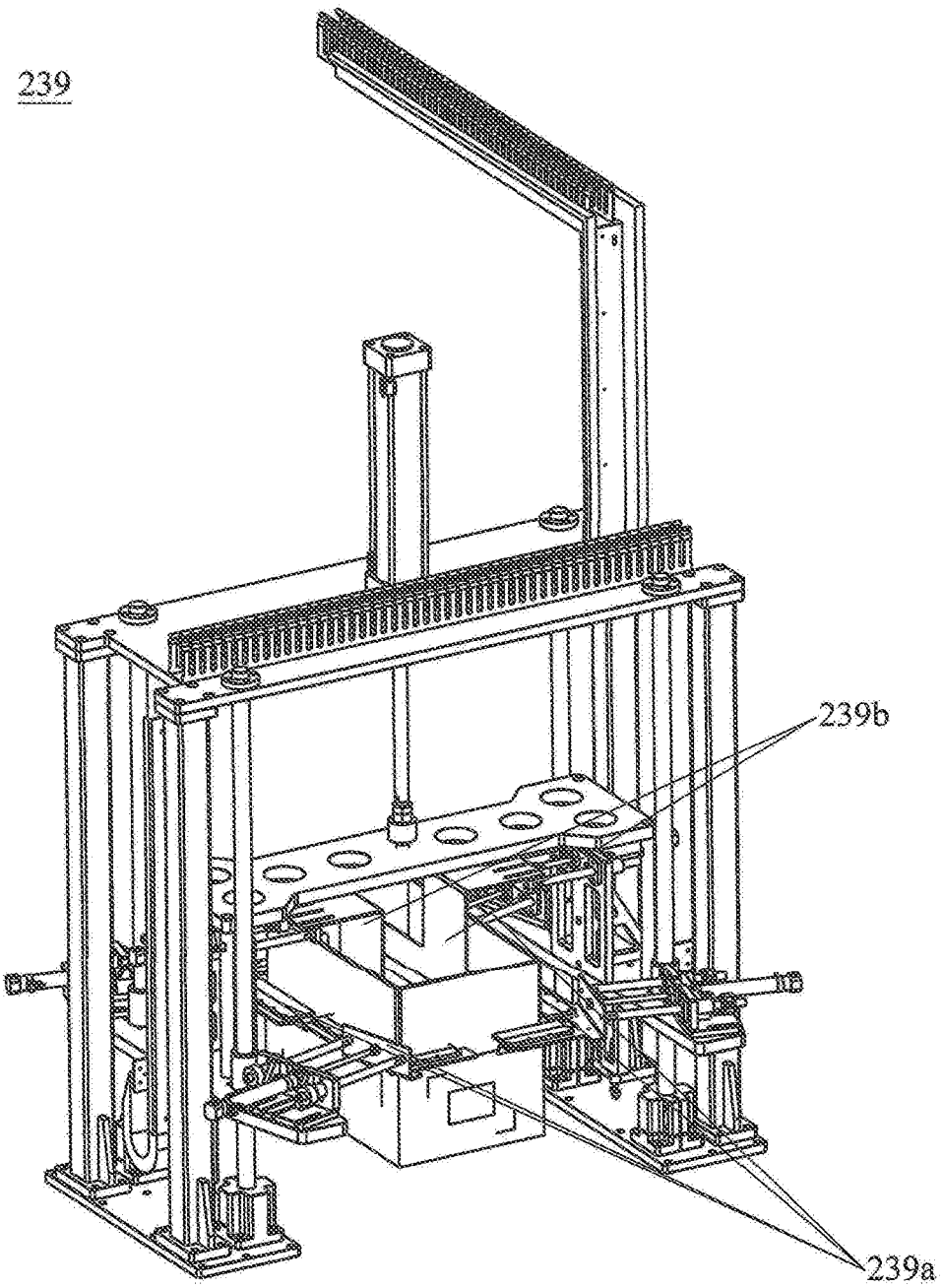
FIG. 15 is a perspective view of a sealing bag flanging mechanism according to the present invention.
Figure 16:
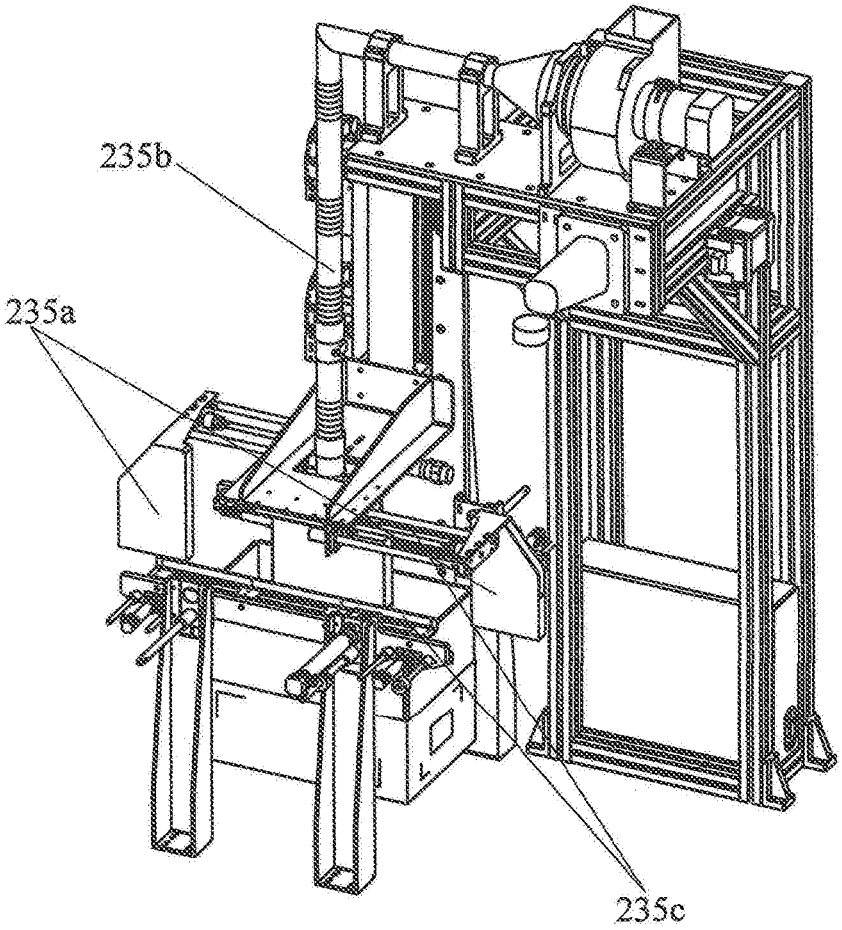
FIG. 16 is a perspective view of a sealing bag heat sealing mechanism according to the present invention.

As shown in FIG. 1, in order to heat-seal the sealing bag that is bagged in the packaging box C, firstly the sealing bag, which is bagged in the outer edge of the packaging box C, is stroked up before sealing the sealing bag, and then sealed. Referring to FIGS. 11-12 and 16, a sealing bag flanging mechanism 239 is also disposed between the packaging position 230*c* and the sealing bag heat sealing mechanism 235. As shown in FIG. 15, the sealing bag flanging mechanism 239 includes a plurality of flexible scrapers 239*a*. When the packaging box C moves to the sealing bag flanging mechanism 239, a plurality of flexible scrapers 239*a* move from bottom to top around the packaging box C for stroking up the sealing bag mouth. The sealing bag flanging mechanism 239 further includes a sealing bag mouth supporting mechanism 239*b*. The sealing bag mouth supporting mechanism 239*b* extends over the mouth of the packaging box C to support and initially sort out the sealing bag mouth so that the sealing bag mouth can be moved to the sealing bag heat sealing mechanism 235 in an upright state.

As shown in FIG. 16, the sealing bag heat sealing mechanism 235 includes a positioning mechanism 235*a* for stretching the sealing bag mouth in the longitudinal direction, a vacuum suction nozzle 235*b* for evacuating the sealing bag, and a welding rod 235*c*. Concretely, the positioning mechanism 235*a* includes two positioning plates 235*a*1 synchronously driven by the power member. When the packaging box C, the sealing bag mouth of which keeps upright, is moved to the sealing bag heat sealing mechanism 235, the positioning device 235*a* extends into the sealing bag mouth and drives the two positioning plates 235*a*1 to move outward along the long side to stretch the sealing bag mouth. After the vacuum suction nozzle 235*b* vacuums the sealing bag, the welding rods 235*c* on both sides move inward to heat seal the sealing bag mouth.

The structure of the packaging box conveying system 300 is similar to the conveying device 130, which is omitted here therefore.

For the packaging box packaging system 400, as shown in FIGS. 2-4, the packaging box packaging system 400 includes a scanning device 410, a sealing device 420, a weighing device 430, and an NG sorting mechanism 440 which are arranged in turn. A scanning device 410 for scanning the inner bag is further provided on a position, where the packaging box packaging system 400 is connected with the packaging box conveying system 300. The scanning device 410 pre-folds four folded edges of the packaging box C by a plurality of power components such as cylinders, thereby facilitating subsequent sealing. The scanning device 410 also scans the product label on the outer wall of the packaging box C and transmits the acquired label information to the weighing device 430. Then, after the pre-folded packaging box C is sealed and packaged by the sealing device 420, it is weighed by the weighing device 430. The weighing device 430 determines weight standard of the packaging box C according to the obtained label information, which judges whether the packaging box C has reached standard or not, and the unqualified packaging box C is sorted and discharged via the NG sorting mechanism 440.

It can be understood, the solid state disk packaging line can be provided with a plurality of detecting mechanisms, such as CCD visual inspection and weight detection. In the process of packaging the solid state disk, when any stacking tray P or the packaging box C with the stacking tray P is found to be defective, if it is in the stage of the stacking tray conveying system 100, the moving identifier information of the corresponding stacking tray P is obtained by scanning the tray fixed identifier of the tray 150, the label information of the packaging box C is obtained, and the defective product is recognized and discharged by the sorting mechanism 440; if it is at a later stage after the packaging system 200, it can be recognized and discharged by the sorting mechanism 440 by scanning the label information of the packaging box C. Thus, even if a small amount of defective products are found in the packaging process, the solid state disk packaging line can continue to operate without stopping, and the defective products are discharged at the final stage, thereby effectively improving efficiency.

A detailed description of the solid state disk packaging line is shown, referring to FIG. 1 to FIG. 16.

Before loading the stacking tray P, the tray 150 is moved to the stacking tray loading device 120, the identifier placer 160 places the stacking tray moving indicator onto the label placement position 153 on the upper side of the tray 150, and the tray fixed identifier on the tray 150 is read and bundled with the stacking tray moving identifier.

The pick-place robot 170 grabs the stacking tray P from the solid state disk bagging system or other mechanism and places it on the tray 150 at the loading position of the stacking tray loading device 120. The tray 150 with the stacking tray P is moved along the upper conveying passage 131 to the tray unloading device 140 driven by the conveying device 130. After the stacking tray P is loaded to the packaging system 200, the empty tray 150 is moved downward along the lower conveying passage 132 to the tray loading machine 110 driven by the tray unloading device 140. The empty tray 150 is lifted upwards by the tray loading machine 110, flush with the upper conveying passage 131 to receive the stacking tray P, and returns to the stacking tray loading device 120. The identifier placer 160 removes the original stacking tray moving indicator and places a new stacking tray moving indicator onto the label placement position 153 so as to carry the next stacking tray P.

When the stacking tray P leaves the tray to the packaging system 200, the tray fixed identifier and the stacking tray moving identifier are disconnected. The disconnected tray fixed identifier carries another stacking tray P after the tray is returned, and then the tray fixed identifier is again bundled with the corresponding stacking tray moving identifier. For the disconnected stacking tray moving identifier, the system automatically transfers the stacking tray information to the packaging system 200 when the corresponding stacking tray P leaves the stacking transport system 100 to the packaging system 200. So the stacking tray P is always monitored. The packaging box loading device 210 unfolds the packaging box C, when the unfolded packaging box C moves to the sealing bag loading device 220, the sealing bag loading device 220 bags the sealing bag into the packaging box C, and the sealing bag mouth is reversely sleeved outside the packaging box C mouth. When the packaging box conveying mechanism 232 transfers the packaging box C to the packaging position, and as is shown in FIG. 14, the adjustment unit 238 adjusts the packaging box C so that the packaging box C is placed in a position facing the stacking tray P and the robot mechanism 231. Then the labeling mechanism labels the outer side wall of the packaging box C.

When the partition loading mechanism 233 puts a partition into the packaging box C located at the packaging position 230*c*, the robot mechanism 231 puts the stacking tray P grabbed from the tray unloading device 140 into the packaging box C. After the partition loading mechanism 233 puts another partition into the packaging box C located at the packaging position 230*c*, and the desiccant loading mechanism 234 puts the desiccant into the packaging box C located at the packaging position 230*c*, the packaging box C is moved by the packaging box conveying mechanism 232 to the sealing bag flanging mechanism 239. After the sealing bag mouth is turned over, then heat sealed by the sealing bag heat sealing mechanism, the packaging box C is moved to the other long side of the frame driven by the packaging box conveying mechanism 232, and conveyed below the partition loading mechanism 233 and the desiccant loading mechanism 234 to transfer the packaging box C to the packaging box conveying system 300.

In this process, the label printing mechanism communicates with the product information base and acquires the stacking tray information to print the corresponding product information into the product label. The labeling mechanism attaches the product label to the outer wall of the packaging box C. After the packaging box conveying system 300 transfers the packaging box C to the packaging box packaging system 400, the scanning device 410 pre-folds four folded edges of the packaging box C, and scans the product label on the outer wall of the packaging box C. Then the pre-folded packaging box C is sealed and packaged by the sealing device 420, and it is weighed by the weighing device 430. The weighing device 430 determines weight standard of the packaging box C according to the obtained label information, which judges whether the packaging box C has reached standard or not. The unqualified packaging box C is sorted and discharged via the NG sorting mechanism 440.

In comparison with the prior art, the solid state disk packaging line works by cooperating with the stacking tray conveying system 100, the packaging box conveying system 300, and the packaging box packaging system 400 to seal solid state disks into a packaging box C. The solid state disk packaging line is highly automated, sealing solid state disks does not require manual operation, which reduces the labor dependence, packages products of different specifications at the same time, avoids doing damage the solid state disk due to the manual packaging, and significantly increases production efficiency.

While the invention has been described in connection with what are presently considered to be the most practical and preferred embodiments, it is to be understood that the invention is not to be limited to the disclosed embodiments, but on the contrary, is intended to cover various modifications and equivalent arrangements included within the spirit and scope of the invention.

What is claimed is:

1. A solid state disk packaging line, for packaging solid state disks, comprising a stacking tray conveying system, a packaging system, a packaging box conveying system, and a packaging box packaging system; the packaging system comprising a packaging box loading device, a sealing bag loading device for loading a sealing bag, and a packaging machine which are arranged linearly; the stacking tray conveying system and the packaging box conveying system being respectively connected with one end of the packaging system having the packaging machine and being located on both sides of the packaging system; and packaging machine being adapted for receiving a stacking tray loaded with solid state disks and conveyed by the stacking tray conveying system, and loading the stacking tray into a packaging box, and then transferring the packaging box to the packaging box packaging system via the packaging box conveying system; and the packaging box packaging system being arranged for sealing the packaging box with the stacking tray loaded therein.

2. The solid state disk packaging line according to claim 1, wherein the stacking tray conveying system comprises a tray loading device, a stacking tray loading device, a conveying device, and a tray unloading device which are arranged linearly, and further comprises a plurality of trays adapted for receiving the stacking tray and moving among the tray loading device, the stacking tray loading device, the conveying device, and the tray unloading device so as to load the stacking tray.

3. The solid state disk packaging line according to claim 2, wherein the tray is provided with a tray fixed identifier, and the stacking tray conveying system further comprises an identifier placer which is adapted for placing a stacking tray moving identifier on the tray and tracing stacking tray information by identifying the tray fixed identifier and the corresponding stacking tray moving identifier.

4. The solid state disk packaging line according to claim 3, further comprising a label printing mechanism for printing a product label, the product label being attached to an outside of the packaging box.

5. The solid state disk packaging line according to claim 2, wherein the conveying device comprises an upper conveying passage and a lower conveying passage, and the tray loading device and the tray unloading device respectively drive the tray to move between the upper conveying passage and the lower conveying passage to convey the tray circularly.

6. The solid state disk packaging line according to claim 1, wherein the packaging machine comprises a packaging box conveying mechanism, a labeling mechanism, a partition loading mechanism, a robot mechanism, a desiccant loading mechanism, and a sealing bag heat sealing mechanism, and the packaging machine has a packaging position; a conveying track of the packaging box conveying mechanism passes through the packaging position and the sealing bag heat sealing mechanism, loading positions of the partition loading mechanism, the robot mechanism and the desiccant loading mechanism are located above the packaging position; and the robot mechanism is configured to transfer the stacking tray to the packaging box located at the loading position, the partition loading mechanism and the desiccant loading mechanism respectively place a partition and desiccant in the packaging box, and the sealing bag loaded by the sealing bag loading device is heat sealed through the sealing bag heat sealing mechanism and then enters the packaging box conveying system.

7. The solid state disk packaging line according to claim 6, wherein the partition loading mechanism, the desiccant loading mechanism, and the sealing bag heat sealing mechanism are all located above the packaging machine, and a conveying track of the packaging box conveying mechanism is located beneath the partition loading mechanism, the desiccant loading mechanism, and the sealing bag heat sealing mechanism.

8. The solid state disk packaging line according to claim 1, wherein the stacking tray conveying system and the packaging system are respectively provided with a robot for receiving the stacking tray, and the robot comprises a lifting finger for lifting the stacking tray and a pushing finger for pressing down the stacking tray.

9. The solid state disk packaging line according to claim 1, wherein the packaging box packaging system comprises a scanning device, a sealing device, a weighing device, and a sorting mechanism which are arranged in turn.

10. The solid state disk packaging line according to claim 1, wherein the stacking tray conveying system and the packaging box conveying system are arranged linearly, and the packaging system and the packaging box packaging system are disposed perpendicularly to the stacking tray conveying system and the packaging box conveying system, and the packaging system and the packaging box packaging system are located on a same side of the stacking tray conveying system and the packaging box conveying system.

* * * * *